US011469529B2

(12) United States Patent
Guillot et al.

(10) Patent No.: US 11,469,529 B2
(45) Date of Patent: Oct. 11, 2022

(54) ELASTIC CONNECTION PIN, CONNECTOR AND ELECTRONIC DEVICE COMPRISING SUCH PINS

(71) Applicant: SAFRAN ELECTRONICS & DEFENSE, Paris (FR)

(72) Inventors: François Guillot, Paris (FR); Pascal Spoor, Paris (FR); Olivier Roche, Paris (FR)

(73) Assignee: SAFRAN ELECTRONICS & DEFENSE, Boulogne-Billancourt (FR)

( * ) Notice: Subject to any disclaimer, the term of this patent is extended or adjusted under 35 U.S.C. 154(b) by 0 days.

(21) Appl. No.: 17/273,859

(22) PCT Filed: Sep. 13, 2019

(86) PCT No.: PCT/EP2019/074592
§ 371 (c)(1),
(2) Date: Mar. 5, 2021

(87) PCT Pub. No.: WO2020/053438
PCT Pub. Date: Mar. 19, 2020

(65) Prior Publication Data

US 2021/0249801 A1 Aug. 12, 2021

(30) Foreign Application Priority Data

Sep. 14, 2018 (FR) ..... 18 58313

(51) Int. Cl.
*H01R 12/58* (2011.01)
*H01R 13/405* (2006.01)

(52) U.S. Cl.
CPC ..... *H01R 12/585* (2013.01); *H01R 13/405* (2013.01)

(58) Field of Classification Search
CPC ..... H01R 12/57; H01R 12/58; H01R 12/585; H01R 13/405; H01R 13/428; H01R 13/04–15
(Continued)

(56) References Cited

U.S. PATENT DOCUMENTS 5,257,947 A 11/1993 Scheer et al.
5,315,072 A * 5/1994 Arai ..... H05K 1/113 174/250
(Continued)

FOREIGN PATENT DOCUMENTS

DE 102011005073 A1 9/2012

OTHER PUBLICATIONS

International Search Report (PCT/ISA/210) issued in corresponding PCT Application PCT/EP2019/074592, with English translation, 4 pages.
(Continued)

*Primary Examiner* — Renee S Luebke
*Assistant Examiner* — Milagros Jeancharles
(74) *Attorney, Agent, or Firm* — Muncy, Geissler, Olds & Lowe P.C.

(57) ABSTRACT

An electrical connector pin having a link segment for linking to the connector and an end segment that is free, the end segment having a cross-section that is flat and being provided with a slot passing through the end segment in its thickness direction and extending over a length of the free end segment to form two mutually parallel blades, each having a first edge that is straight beside the slot and a second edge extending remotely from the slot and that is provided with a contact portion projecting laterally relative to an outside surface of the link segment, the blades being
(Continued)

elastically deformable transversely so as to vary the width of the slot. A connector and an electronic device including such a pin.

7 Claims, 2 Drawing Sheets

(58) Field of Classification Search
USPC ..... 439/82, 571
See application file for complete search history.

(56) References Cited

U.S. PATENT DOCUMENTS

| | | | | | |
|---|---|---|---|---|---|
| 5,827,089 | A * | 10/1998 | Beck, Jr. | H01R 12/7064 | 439/567 |
| 6,022,243 | A * | 2/2000 | Yang | H01R 12/7052 | 439/567 |
| 6,132,247 | A * | 10/2000 | Liou | H01R 12/7029 | 439/381 |
| 6,750,404 | B1 * | 6/2004 | Anslow | H05K 1/113 | 174/261 |
| 2013/0312257 | A1 | 11/2013 | Day, Jr. et al. | | |
| 2014/0099839 | A1 * | 4/2014 | Trout | H01R 12/585 | 439/817 |
| 2015/0255901 | A1 * | 9/2015 | Kim | H01R 12/585 | 439/78 |

OTHER PUBLICATIONS

Written Opinion (PCT/ISA/237) issued in corresponding PCT Application PCT/EP2019/074592, with English translation, 7 pages.

* cited by examiner

ELASTIC CONNECTION PIN, CONNECTOR AND ELECTRONIC DEVICE COMPRISING SUCH PINS

TECHNOLOGICAL BACKGROUND

It is known that an electronic device or component can be connected to a printed circuit board (PCB) by using a connector having pins for engaging in holes that have been provided in the printed circuit board and that possess inside surfaces covered in an electrically conductive coating and connected to conductor tracks of the printed circuit. These are referred to as plated holes or vias.

A pin is generally made of conductive metal and includes an end segment that is elastically deformable in a direction that is transverse relative to a longitudinal direction of the pin so that the end segment has two outside surface portions that are diametrically opposite each other and suitable for being moved elastically towards each other. The end segment can thus be engaged by force in the plated hole and its elasticity serves to provide permanent contact between the conductive coating of the plated hole and the outside surface portions of the end segment of the pin.

Several forms of pin are known. By way of example, the most common in ordinary applications are split pins of round section or so-called "banana" pins.

Those pins are not suitable for use in applications in which the pins are highly stressed (mechanical, vibratory, thermal, . . . , stresses) and in particular in aviation where resistance to such stresses is the subject of standards such as the ARINC 600 standard.

† Translation of the title as established ex officio.

For such applications, it is known to use connectors of the press-fit type having pins in which the end segment is in the shape of the "eye" of a needle, i.e. between a proximal solid portion and a distal solid portion, the end segment has an intermediate portion comprising two outwardly arcuate blades so as to have outside surface portions that are spaced apart from each other by a distance that is greater than the greatest transverse direction of the remainder of the end segment. The blades have first converging ends that are connected to the proximal solid portion and second converging ends that are connected to the distal solid portion, with the outside surface portions providing contact with the plated hole being located on curved intermediate portions of the blades.

A drawback of that type of pin is that is can be found to be relatively expensive to manufacture when it is to provide a connection that is reliable under certain conditions of use.

Another drawback of that type of pin is that the plated hole needs to be of length that is sufficient to receive the distal portion and the intermediate portion of the end segment of the pin while ensuring that the outside surface portions in contact with the electrically conductive coating of the plated hole are engaged far enough inside the plated hole to avoid any risk of becoming extracted therefrom under the effect of stresses applied to the connector and/or to the printed circuit board. Thus, it is considered that the points of contact between the outside surface portions of the pin and the electrically conductive coating of the plated hole need to be at a minimum depth of 0.3 millimeters (mm) relative to the inlet of the plated hole.

This thus determines the minimum thickness of the printed circuit board.

OBJECT OF THE INVENTION

An object of the invention is to provide an electrical connector pin that provides a reliable connection.

BRIEF SUMMARY OF THE INVENTION

To this end, the invention provides a pin for an electrical connector, the pin comprising a link segment for linking it to the connector and an end segment that is free, the end segment having two mutually parallel blades that are spaced apart from each other, each blade having two main faces that are connected together by two edges that are substantially parallel to a longitudinal direction of the pin and one of which is provided with at least one contact portion that projects laterally relative to an outside surface of the link segment and that is arranged to bite into a surface against which it is pressed, the contact portions extending oppositely to each other and the blades being elastically deformable between a rest position and a close-together position in which the contact portions are closer together.

Thus, the structure of the pin is relatively simple and the pressure exerted by the contact portions on the surface of the housing that is to receive the pin can be adjusted by acting on the distance between the two edges of the blade and/or the material that is chosen. This structure also makes it possible to have an end segment that is relatively short and thus suitable for being used in holes of depth that is relatively small (in particular compared with present-day solutions of the "press-fit" type).

Preferably, the end segment has a cross-section that is flat and that is provided with a slot passing through the end segment in its thickness direction and extending over a length of the free end segment so as to form the two blades, each of the two blades having a first edge lying beside the slot and that is straight, and a second edge lying remotely from the slot and that has the contact portion projecting laterally therefrom, the blades being elastically deformable transversely so as to vary the width of the slot.

In a variant, the blades are offset relative to each other in a direction perpendicular to their main faces by a distance that is greater than the thickness of the blades.

The invention also provides an electronic device and a connector implementing such pins.

Other characteristics and advantages of the invention appear on reading the following description of a particular and nonlimiting embodiment of the invention.

BRIEF DESCRIPTION OF THE DRAWINGS

Reference is made to the accompanying drawings, in which.

DETAILED DESCRIPTION OF THE INVENTION

Figure 1:
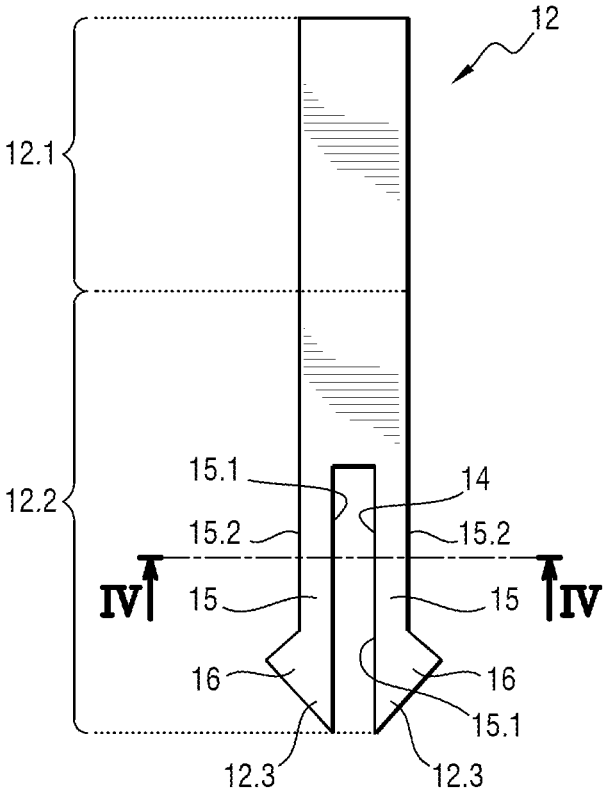
FIG. 1 is an elevation view of a pin of the invention.
Figure 2:
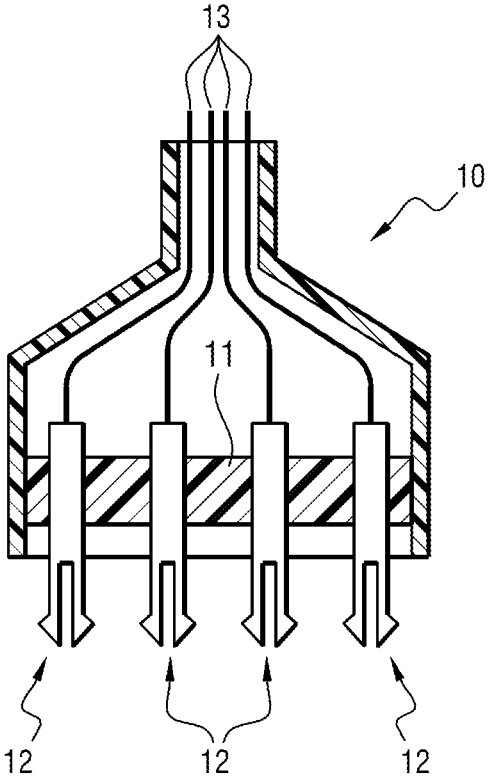
FIG. 2 is a section view of a connector of the invention.
Figure 3:
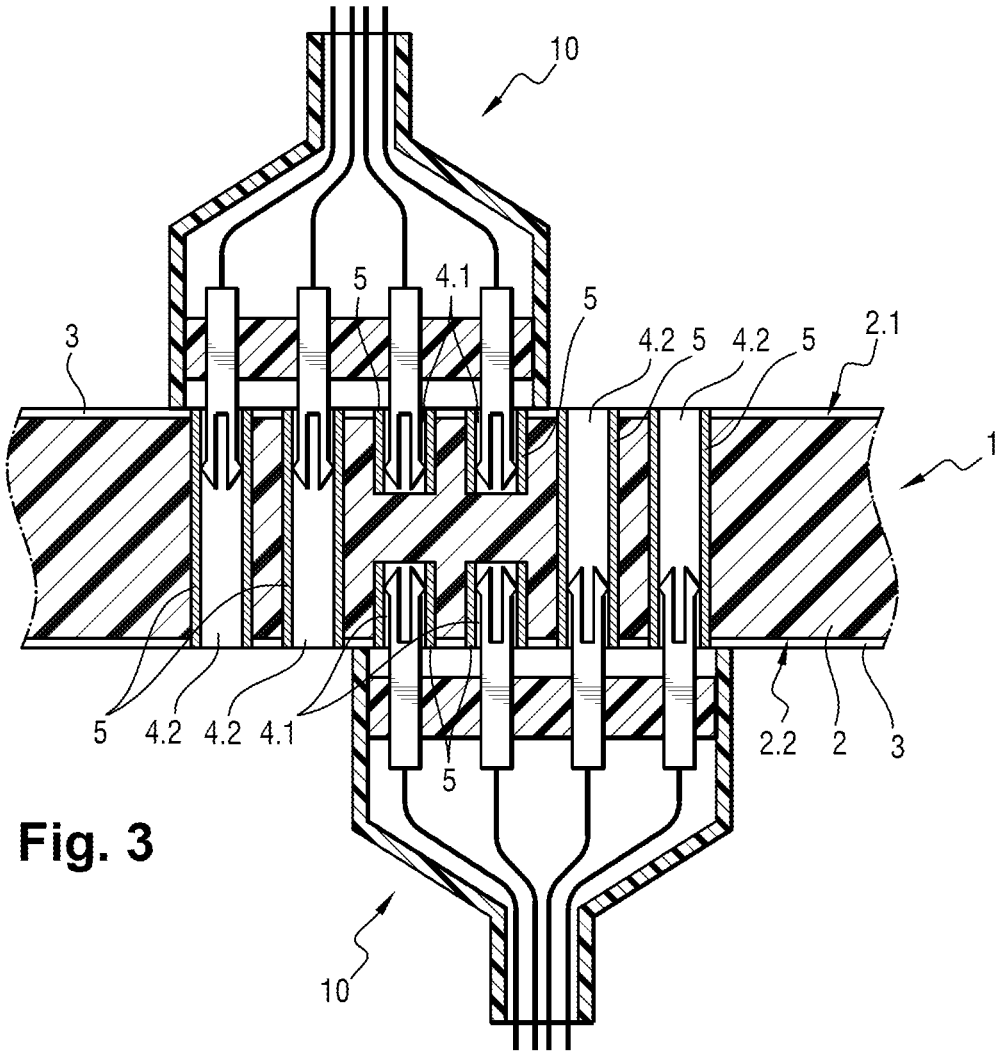
FIG. 3 is a fragmentary view in cross section of a printed circuit board having plated holes receiving pins of a connector of the invention.

With reference to FIGS. 1 to 4, the invention is described by way of example in application to an electronic device including a printed circuit board (PCB) given overall reference 1, which PCB comprises an electrically insulating substrate 2 that carries electrically conductive tracks 3 and that is provided with holes 4.1, 4.2, each of which is covered by an electrically conductive internal coating 5 that is connected to an electrically conductive track 3.

The holes include two series of holes 4.1 that are blind and that extend on common axes from opposite faces 2.1 and 2.2 of the substrate 2.

The holes include other holes 4.2 that are through holes opening out into both of the faces 2.1 and 2.2.

In this example, the substrate has a thickness of 3.2 mm and the holes 4.1 have a depth of about 1.4 mm.

The device includes connectors 10, each comprising a base 11 having pins fastened thereto, the pins being given overall reference 12.

Each pin 12 possesses:

- a link segment 12.1 fastened to the base 11 and connected to an electric cable 13; and
- an end segment 12.2 extending the link segment 12.1 and having a free terminal portion 12.3.

The link segments 12.1 are fastened to the base 11 in conventional manner, e.g. by overmolding. Each link segment 12.1 is electrically connected to an electric cable 13 in conventional manner, e.g. by soldering.

In this example, the link segment 12.1 and the end segment 12.2 are made out of a single piece of metal. In this example, the metal used is one of the following alloys: CuSn4, CuSn6, CuNiSi, CuCrAgFeTiSi. Each pin 12 is manufactured by being cut out from a sheet of the specified metal. Provision is made for surface treatment by depositing a layer of nickel having a thickness of about 1.5 micrometers (μm) with a so-called "flash" nickel finish over a thickness of about 0.3 μm to 1.0 μm. Each pin 12 is manufactured by being cut out from a sheet of the specified metal. It is naturally possible to envisage using other electrically conductive materials, and in particular metals and alloys.

The pin 12 is of flat elongate shape. The term "flat" is used to mean that the pin 12 presents thickness that is smaller than its width measured perpendicularly to its longitudinal direction.

In this example, the pin 12 is rectangular in section.

According to the invention, the end segment 12.2 is provided with a slot 14 passing through the end segment in its thickness direction and extending over a length of the end segment 12.2 in order to form two blades 15. The blades 15 are parallel to each other, and each of them has two main faces that are parallel to each other (one of which can be seen flat in FIG. 1) and that are connected together by a first edge 15.1 that is straight and beside the slot 14 and by a second edge 15.2 that is remote from the slot 14.

The blades 15 are elastically deformable in a transverse direction to vary the width of the slot, i.e. the blades 15 can be moved towards each other and can subsequently return elastically to a rest position in which they are parallel to each other. Preferably, the end segment 12.2 is made of material such that, when the blades are moved towards each other so that they touch, the elastic limit of material is not reached, i.e. once the force moving them towards each other ceases, the blades 15 can return elastically to their rest position.

The second edge 15.2 is provided with a contact portion 16 that projects laterally relative to an outside surface of the link segment 12.1 and that is arranged to bite into the surface against which it is pressed. In this example, the contact portions 16 are substantially triangular in shape, each having a sharp vertex for biting into the surface of the internal coating 5 against which it is pressed. When the blades 15 are in the rest position, the vertices of the contact portions 16 are spaced apart from each other by a distance that is greater than the diameter of the holes 4.1, 4.2.

The contact portions 16 are arranged on a terminal portion 12.3 of the end segment 12.2. In this example, the terminal portion 12.3 is chamfered to make it easier to insert the end segment 12.2 into the hole 4.1, 4.2 that it is to occupy. In a variant, and for the same purpose, the terminal portion 12.3 could be rounded.

The connectors are mounted on the electronic card 1 by engaging the end segments 12.2 in the holes 4.1, 4.2. Doing this causes the elastic blades 15 to deform transversely, with this deformation taking place progressively as a result of the shape of the terminal portion 15.3 (the chamfers also make it easier to center the pin in the hole). It should be observed that the force needed to deform of the blades 15 depends in particular on the length of the slot 14. Thus, the length of the slot 14 should be determined as a function of the desired insertion force and of the pressure with which the contact portions 16 are to press against the internal coating 5.

Once the connectors are mounted on the electronic card 1, each of the end segments 12.2 of the pins 12 is received in a respective hole 4.1 or 4.2 and the blades 15 remain elastically deformed so that the contact portions 16 are pressed elastically against the electrically conductive coating 5. Preferably, the end segment (12.2) is made of a material such that, when the blades (15) are pressed against each other, the elastic limit of material is not reached.

It should also be observed that using blind holes 4.1 and relatively short pins 12 serves to maximize high frequency passbands by minimizing the "stub" effect of the plated holes on matched lines at high frequencies.

Figure 4:
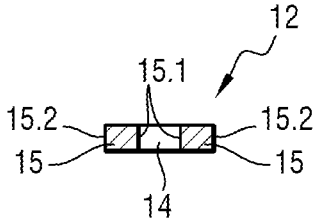
FIG. 4 is a view of the pin of the invention in cross-section on line IV-IV in FIG. 1.

In FIG. 4, it should be observed that the blades 15 of the pin 12 lie in a common plane that is parallel to the longitudinal axis of the pin 12 and that passes through the middles of the edges 15.1 and 15.2.

Figure 5:
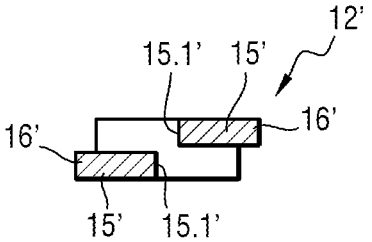
FIG. 5 is an end view (seen from the free end) of a pin in a variant embodiment, the blades being shown in a rest position.
Figure 6:
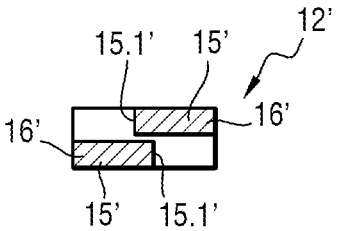
FIG. 6 is a view analogous to FIG. 5 showing the pin of this variant embodiment, the blades being in a closer-together position.

In contrast, in the variant of FIGS. 5 and 6, the pins 12' have blades 15' that are offset from each other in a direction perpendicular to the main faces of the blades by a distance that is greater than the thickness of the blades.

Thus, when the blades 15' are in their close-together position and the vertices of the contact portions 16' are spaced apart by a distance that is substantially equal to the diameter of the hole 4.1, 4.2 (see FIG. 6), the edges 15.1' of the blades 15' do not come into contact with each other since the blades 15' overlap in part as a result of being relatively offset.

Naturally, the invention is not limited to the embodiment described and covers any variant coming within the ambit of the invention as defined by the claims.

In particular, the electronic device may be of any structure, and in particular: it may have a number of holes that is different from that shown, its holes may be blind or through only, only without facing holes, with a multi-layer PCB or a single-layer PCB. The substrate may be of a different thickness and the holes may be of a different depth.

Any technology may be used for mounting components on the printed circuit board.

The connector may be of a structure different from that described. The connector may optionally comply with the ARNIC 600 standard, it may be a series connector or a parallel connector, or in general manner it may be any connector having pins . . . .

The pins may be of a structure different from that described, and in particular:

- the link segment may be of any section (e.g. not flat) providing its section gives it sufficient stiffness (resistance to buckling) to enable the end segment to be engaged in the plated hole, and for example it may be tubular, circular, square;
- the end segment may have edges that are plane or that are rounded (about axes parallel to the longitudinal direction of the end segment);
- the end segment may have an end that is pointed in order to facilitate inserting it in a hole. Nevertheless, it is preferable to have an end that is chamfered (having the shape of a tapering tip) as shown in figures, since then the centering function does not give rise to any significant increase in the length of the end segment;
- it is possible to act on the slope of the rear surfaces of the contact portions 17 so as to enable the pin to be removed by an operator;
- the contact portions may be rounded in shape (circular or elliptical) providing each of them includes at least one sharp edged enabling it to bite into the surface against which it is applied, or they may be of some other shape;
- the contact portions may extend over all or part of the length of the end segment;
- the contact portions may be set back from the terminal portion of the end segment;
- in the variant embodiment of FIGS. 5 and 6, the edges 15.1' may optionally lie in the same plane when in the rest position (if not in the same plane, the blades may overlap a little, or on the contrary they may be spaced apart by a gap as shown in FIGS. 5 and 6);
- the slot may extend as far as the link segment, and it may even extend into the link segment; and
- the end segment may be attached to the link segment, in particular by welding or soldering . . . .

The invention claimed is:

1. An electronic device comprising:

a printed circuit board having conductor tracks and holes, each hole provided with an electrically conductive coating connected to a conductive track; and at least one connector provided with pins, each pin comprising a link segment for linking the pin to the connector and an end segment that is free, the end segment having two mutually parallel blades that are spaced apart from each other, each blade having two main faces that are connected together by two edges that are substantially parallel to a longitudinal direction of the pin and one of which is provided with at least one contact portion that projects laterally relative to an outside surface of the link segment and that is arranged to bite into a surface against which it is pressed, the contact portions extending oppositely to each other and the blades being elastically deformable between a rest position and a close-together position in which the contact portions are closer together, wherein the end segment has a cross-section that is flat and that is provided with a slot passing through the end segment in its thickness direction and extending over a length of the free end segment so as to form the two blades, each of the two blades having a first edge lying beside the slot and that is straight, the first edges being parallel one to the other when the blades are in the rest position, and a second edge lying remotely from the slot and that has the contact portion projecting laterally therefrom, the blades being elastically deformable transversely so as to vary the width of the slot, each of the end segments of the pins being received in a respective hole, and the blades being deformed elastically in such a manner that the contact portions are pressed elastically against the electrically conductive coating and have penetrated into the electrically conductive coating.

2. The device according to claim 1, wherein two of the holes are blind holes and extend along a common axis from mutually opposite faces of a substrate of the board.

3. The device according to claim 1, wherein the slot also extends into a fraction of the link segment.

4. The device according to claim 1, wherein the end segment is made of a material such that, when the blades are pressed against each other, the elastic limit of material is not reached.

5. The device according to claim 1, wherein the contact portions are substantially triangular in shape.

6. The device according to claim 1, wherein the contact portions are arranged on a terminal portion of the end segment.

7. The device according to claim 1, wherein the end segment has a terminal portion that is chamfered or rounded.

* * * * *